US008696490B2

(12) United States Patent
Ban

(10) Patent No.: US 8,696,490 B2
(45) Date of Patent: Apr. 15, 2014

(54) GOLF CLUB HEAD AND METHOD OF MANUFACTURING THE SAME

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 487 days.

(21) Appl. No.: 12/969,105

(22) Filed: Dec. 15, 2010

(65) Prior Publication Data

US 2011/0151999 A1 Jun. 23, 2011

(30) Foreign Application Priority Data

Dec. 18, 2009 (JP) ..... 2009-287879

(51) Int. Cl.
*A63B 53/04* (2006.01)

(52) U.S. Cl.
USPC ..... 473/330; 473/342

(58) Field of Classification Search
USPC ..... 473/324–350
See application file for complete search history.

(56) References Cited

U.S. PATENT DOCUMENTS

| | | | | | |
|---|---|---|---|---|---|
| 4,529,203 | A * | 7/1985 | Ribaudo | 473/331 |
| 5,100,144 | A * | 3/1992 | Okumoto et al. | 473/331 |
| 5,207,427 | A * | 5/1993 | Saeki | 473/343 |
| 5,935,018 | A * | 8/1999 | Takeda | 473/324 |
| 5,967,903 | A * | 10/1999 | Cheng | 473/342 |
| 6,059,670 | A * | 5/2000 | Mogan | 473/342 |
| 6,638,179 | B2 * | 10/2003 | Yoshida | 473/324 |
| 7,594,862 | B2 * | 9/2009 | Gilbert | 473/330 |
| 7,695,377 | B2 | 4/2010 | Yamagishi et al. | |
| 7,771,288 | B2 * | 8/2010 | Gilbert et al. | 473/324 |
| 7,780,549 | B2 * | 8/2010 | Park et al. | 473/331 |
| 7,846,039 | B2 * | 12/2010 | Gilbert et al. | 473/331 |
| 7,927,230 | B2 * | 4/2011 | Solheim | 473/329 |
| 8,075,420 | B2 * | 12/2011 | Rick | 473/342 |
| 8,172,698 | B2 * | 5/2012 | Solheim | 473/329 |
| 8,172,699 | B2 * | 5/2012 | Nakamura | 473/330 |
| 2002/0025861 | A1 * | 2/2002 | Ezawa | 473/342 |
| 2009/0176597 | A1 | 7/2009 | Yamagishi et al. | |
| 2009/0291774 | A1 * | 11/2009 | Bennett | 473/332 |
| 2010/0113180 | A1 * | 5/2010 | Nakamura | 473/331 |
| 2011/0151998 | A1 * | 6/2011 | Ban | 473/331 |
| 2011/0151999 | A1 * | 6/2011 | Ban | 473/331 |
| 2012/0190477 | A1 * | 7/2012 | Nakamura | 473/331 |
| 2012/0264537 | A1 * | 10/2012 | Breier et al. | 473/331 |

FOREIGN PATENT DOCUMENTS

| | | | | |
|---|---|---|---|---|
| JP | 02116389 | A * | 5/1990 | A63B 53/04 |
| JP | 06114128 | A * | 4/1994 | A63B 53/04 |
| JP | 09206411 | A * | 8/1997 | A63B 53/04 |
| JP | 10-277185 | A | 10/1998 | |
| JP | 2000014839 | A * | 1/2000 | A63B 53/04 |
| JP | 2008-023178 | A | 2/2008 | |
| JP | 2010110425 | A * | 5/2010 | |
| JP | 2011125541 | A * | 6/2011 | |
| JP | 2011125542 | A * | 6/2011 | |

* cited by examiner

*Primary Examiner* — Alvin Hunter
(74) *Attorney, Agent, or Firm* — Sughrue Mion, PLLC

(57) ABSTRACT

A golf club head according to this invention has scorelines formed in its face surface. A plated layer is formed on at least the face surface of a head base body before the scorelines are formed in the face surface, and the face surface is grooved to form the scorelines in it.

3 Claims, 2 Drawing Sheets

GOLF CLUB HEAD AND METHOD OF MANUFACTURING THE SAME

BACKGROUND OF THE INVENTION

1. Field of the Invention

The present invention relates to a golf club head and a method of manufacturing the same and, more particularly, to a golf club head suitable as an iron type golf club head and a method of manufacturing the same.

2. Description of the Related Art

An iron type golf club head has grooves called scorelines, which are formed in its face surface. It is often the case that a plated layer is formed on at least the face surface of the club head in order to, for example, increase the hardness of the face surface and improve its corrosion resistance and appearance.

In a conventional method of manufacturing an iron type golf club head coated with a plated layer, at least the face surface of a head base body before scorelines are formed in the face surface is grooved to form the scorelines in it and is plated (Japanese Patent Laid-Open No. 10-277185). In this patent reference, after the plating, the plated layer is blasted to facilitate getting a back spin.

Japanese Patent Laid-Open No. 2008-23178 describes a golf club head having cutting traces formed in its face surface by milling the face surface (by cutting it using a milling machine). This patent reference describes that the milling is preferably performed without forming any plated layer on the face surface.

As in Japanese Patent Laid-Open No. 10-277185, when the face surface of a head base body is grooved to form scorelines in it and is plated, the accuracy of the edges of the scorelines, on which their groove side surfaces and the face surface intersect with each other, deteriorates. That is, when the face surface of a head base body is grooved to form scorelines in it, the edges of the scorelines, on which their groove side surfaces and the face surface intersect with each other, have an ideal edge shape, but the edge accuracy deteriorates upon forming a plated layer on the face surface in order to, for example, improve its durability, because the plated layer has a certain thickness.

SUMMARY OF THE INVENTION

The present invention has been made in order to solve the above-mentioned problem, and has as its object to manufacture a golf club head in which a plated layer is formed in its face surface and which has a higher accuracy of the edges of scorelines, on which their groove side surfaces and the face surface intersect with each other.

According to an aspect of the present invention, there is provided a golf club head having scorelines formed in a face surface thereof, wherein a plated layer is formed on at least the face surface of a head base body before the scorelines are formed in the face surface, and the face surface is grooved to form the scorelines therein.

According to another aspect of the present invention, there is provided a method of manufacturing a golf club head having scorelines formed in a face surface thereof, the method comprising the steps of: forming a plated layer on at least the face surface of a head base body before the scorelines are formed in the face surface; and grooving the face surface, on which the plated layer is formed, to form the scorelines therein.

Further features of the present invention will become apparent from the following description of exemplary embodiments with reference to the attached drawings.

DESCRIPTION OF THE EMBODIMENTS

An embodiment will be described below with reference to FIGS. 1, 2A, and 2B.

Figure 1:
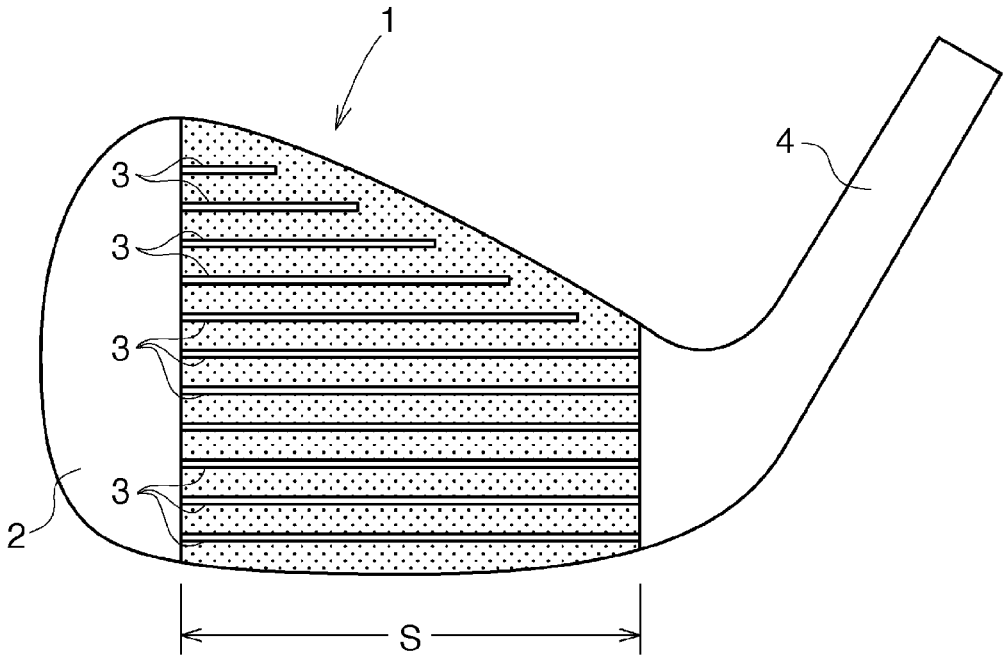
FIG. 1 is a front view of an iron type golf club head according to an embodiment of the present invention.

FIG. 1 is a front view of a golf club head 1 having a large number of scorelines 3 formed in a face surface 2. A golf club is formed by inserting a shaft into a hosel portion 4 provided on the golf club head 1, and fixing it in position using an adhesive.

Figure 2A:
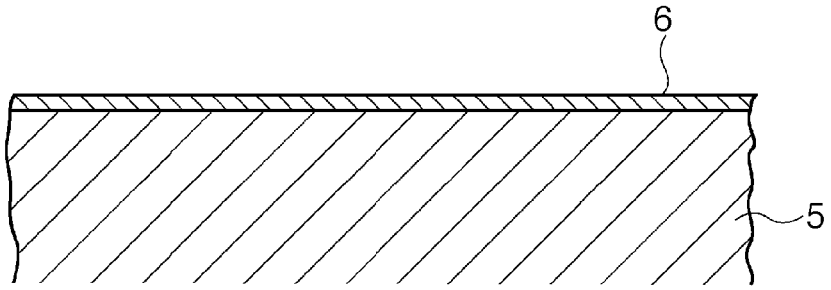
FIGS. 2A and 2B are sectional views of the face surface, which show a method of forming scorelines in it.
Figure 2B:
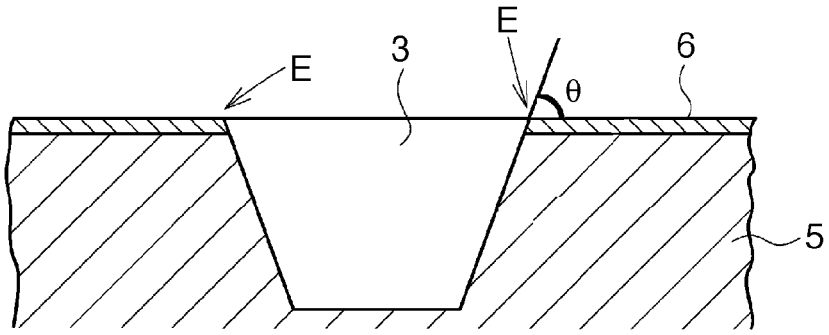

As shown in FIGS. 2A and 2B, the golf club head 1 is manufactured by forming a plated layer 6 on at least the face surface 2 of a head base body 5 made of an iron-based material or a metal material such as aluminum or titanium, and grooving the face surface 2 to form the scorelines 3 in it.

The scorelines 3 preferably have an open-side groove width of 0.6 to 0.9 mm and a depth of 0.2 to 0.5 mm. Although the scorelines 3 have a trapezoidal cross-section and have an angle θ of about 45° to 80° that the face surface makes with their groove side surfaces in this embodiment, they may be right-angled grooves with an angle θ=90°. Also, the scorelines 3 may have a roughly U-shaped or roughly semielliptical cross-section.

The plated layer 6 preferably includes one or two or more layers plated with, for example, chromium or nickel, and preferably has a thickness (an overall thickness if it includes a plurality of layers) of 5 to 60 μm, and especially, about 15 to 50 μm.

The plated layer 6 may be formed by either electroless plating or electrolytic plating. However, electroless plating is more preferable than electrolytic plating because in the former a plated layer with a uniform thickness can be more easily formed. Preferable examples of electroless plating include nickeline plating.

A golf club head 1 as mentioned above is preferably manufactured by the following method.

First, a head base body 5 is manufactured by casting or forging. The head base body 5 has nearly the same shape and size with the golf club head 1, except that in the former scorelines 3 have not yet been formed in it.

Next, the face surface of the head base body 5 is preferably milled into a flat surface with a specific flatness. In this processing, the face surface is preferably cut by a cutting machine while the head base body 5 is fixed in position.

At least a face surface 2 of the head base body 5 is plated to form a plated layer 6 on it. The plated layer 6 may be provided only on the face surface 2 or provided not only on the face surface 2 but also in other portions. The plated layer 6 may be provided on, for example, the entire surface of the head base body 5.

Lastly, the face surface 2 is grooved to form scorelines 3 in it. The shape of a cutting tool (end mill) for grooving is not particularly limited, and may be, for example, a shape tapered at the same angle as the angle θ of the side surfaces of the scorelines 3 shown in FIG. 2B. Also, the cutting tool may have its lower half with a shape tapered at the same angle as the angle θ, and its upper half with a shape tapered at a slope larger than the lower half (that is, a shape in which the angle that the face surface 2 makes with the upper half side surfaces is smaller than the angle θ), so that the lower and upper halves are smoothly continuous with each other at their boundary portion. By grooving the face surface 2 using this cutting tool such that the boundary portion of the cutting tool is flush with the surface of the plated layer 6, edges (to be also referred to as the edges of the scorelines hereinafter) E of the scorelines 3, on which their groove side surfaces and the face surface 2 intersect with each other, can be formed into a shape conforming to that boundary portion. In addition, the edges E may be burred as needed after the scorelines 3 are formed.

Before or after the scorelines 3 are formed, the face surface 2 may be blasted as needed. With this processing, the plated layer is frosted. Although the face surface 2 is preferably blasted only in a scoreline forming region S shown in FIG. 1 to visually indicate the player the ball hitting surface, the entire face surface 2 or the lower surface of the head may be blasted. With this processing, the friction coefficient of the face surface 2 is expected to increase. Examples of the blasting include sandblasting and shot blasting. The blasting may be performed either before or after the scorelines 3 are formed. However, the blasting is preferably performed before the scorelines 3 are formed, in order to maintain a given accuracy of the edges E of the scorelines 3.

The golf club head 1 is manufactured by the foregoing processes, but the above-mentioned blasting may be omitted. Also, a process of milling the head base body 5 may be added to the foregoing processes.

In the milling, the face surface is shallowly cut using, for example, a milling machine to form a large number of minute recessed streaks (grooves) in it. With this processing, the friction coefficient of the face surface increases, and this facilitates getting a back spin. The pitch of the cutting traces produced by the milling preferably is about 0.1 to 1 mm. Even if the milling takes place, the plated layer 6 formed on the face surface 2 preferably has a thickness of 5 to 60 μm, as described earlier. When the milling height is set to 25 μm that is the upper limit of a golf rule, the plated layer preferably has a thickness of 15 to 50 μm. The milling pattern may be formed by a laser.

Instead of milling the head base body 5 in the foregoing way, the plated layer 6 may be milled after it is formed on the head base body 5. In this case, it is preferable that only the plated layer 6 on the face surface 2 is milled, and the head base body 5 under it is not milled. This prevents the head base body 5 under the plated layer 6 from being exposed and rusting. A golf rule stipulates that the milling height (the depth of the streaks) must be 25 μm or less, so the plated layer preferably has a thickness of 25 μm or more. The milling may be performed either before or after the scorelines 3 are formed.

In the golf club head 1 according to this embodiment, the plated layer 6 is formed on the face surface 2 of the head base body 5, and the face surface 2 is grooved to form the scorelines 3 in it. Since the plated layer 6 is formed on the face surface 2 of the head base body 5, the use of a material excellent in durability and appearance as the plated layer 6 allows the golf club head 1 to be excellent in, for example, durability. Also, since the face surface 2 is grooved after the plated layer 6 is formed, the edges E of the scorelines 3 are formed with high precision by the grooving.

The edges E of the above-mentioned scorelines may be angled edges or non-angled round edges. The round edges preferably have an effective radius of 0.05 mm to 0.3 m, and especially, 0.1 mm to 0.2 mm. Thus, the golf club head 1 becomes less likely to damage a golf ball, and allows the player to produce an appropriate back spin.

When the face surface 2 of the head base body 5 is milled into a flat surface before the plated layer 6 is formed, the surface accuracy of the face surface 2 becomes high.

Although the golf club head 1 is of the iron type in this embodiment, the present invention is also applicable to a hybrid golf club head having its face surface made of a metal material and its remaining part at least partially made of, for example, carbon, a synthetic resin, a fiber-reinforced synthetic resin, or ceramics.

Although only the plated layer 6 is formed on the head base body 5 in this embodiment, another layer may be formed between the head base body 5 and the plated layer 6 and/or on the upper surface of the plated layer 6. For example, the surface of the head base body 5 may be carburized or nitrided to form a hard layer on it. Also, a layer such as a carbon layer (for example, a diamond-like carbon layer) may be formed between the head base body 5 and the plated layer 6 and/or on the upper surface of the plated layer 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-287879, filed Dec. 18, 2009, which is hereby incorporated by reference herein in its entirety.

What is claimed is:

1. A method of manufacturing a golf club head having scorelines formed in a face surface thereof, said method comprising the steps of:

forming a plated layer on at least the face surface of a head base body before the scorelines are formed in the face surface; and grooving the face surface, on which the plated layer is formed, to form the scorelines therein, wherein the face surface of the head base body is milled into a flat surface before the step of forming the plated layer.

2. A method of manufacturing a golf club head having scorelines formed in a face surface thereof, said method comprising the steps of:

forming a plated layer on at least the face surface of a head base body before the scorelines are formed in the face surface;

grooving the face surface, on which the plated layer is formed, to form the scorelines therein, and blasting the plated layer.

3. A method of manufacturing a golf club head having scorelines formed in a face surface thereof, said method comprising the steps of:

forming a plated layer on at least the face surface of a head base body before the scorelines are formed in the face surface; and grooving the face surface, on which the plated layer is formed, to form the scorelines therein, wherein the plated layer is formed without interruption between the adjacent scorelines.

* * * * *